US006940044B2

(12) United States Patent
Eskey

(10) Patent No.: US 6,940,044 B2
(45) Date of Patent: Sep. 6, 2005

(54) SYSTEM AND METHOD FOR UTILIZING A USER NON-PERCEIVABLE LIGHT SOURCE IN A MACHINE

(75) Inventor: Eric Unger Eskey, Meridian, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/620,139

(22) Filed: Jul. 14, 2003

(65) Prior Publication Data

US 2004/0008979 A1 Jan. 15, 2004

Related U.S. Application Data

(62) Division of application No. 10/081,370, filed on Feb. 22, 2002, now Pat. No. 6,649,874.

(51) Int. Cl.[7] ..... G03G 15/20
(52) U.S. Cl. ..... 219/216; 399/329
(58) Field of Search ..... 219/216, 469–471; 362/29, 30, 297, 307, 310, 311; 399/8, 81, 330–332, 336

(56) References Cited

U.S. PATENT DOCUMENTS 4,616,291 A * 10/1986 Sarnezki et al. ..... 362/29
2002/0001185 A1 * 1/2002 Wilhelm et al. ..... 362/30
2003/0164370 A1 * 9/2003 Aihara et al. ..... 219/506

FOREIGN PATENT DOCUMENTS

JP 11084921 A * 3/1999

* cited by examiner

*Primary Examiner*—J. Pelham

(57) ABSTRACT

A apparatus and method for fusing toner to media in a laser imaging device. A paraboloidal trough reflector is positioned about a linear heating element to focus and concentrate radiant energy emitted from the heating element onto a thermal spreader. The thermal spreader absorbs the radiant energy and converts it to heat. A thermoplastic fusing roller is rotatably supported about the bulb heater, the reflector and the thermal spreader. A pressure roller is supported to urge media against the fusing roller at the position of the thermal spreader. Fusing heat is conducted from the thermal spreader, through the fusing roller and to the media. The pressure roller is driven to rotate, thereby advancing the media through the fusing unit to fuse the toner thereto. Additionally, the present teachings disclose a printing device having a fusing unit with a bulb heater that emits user non-perceivable light. A mechanism is included for conveying light from the bulb heater to a location within the printing device. Also, a component positioned to receive the light and to utilize the light for illumination thereof in a user perceivable manner.

18 Claims, 5 Drawing Sheets

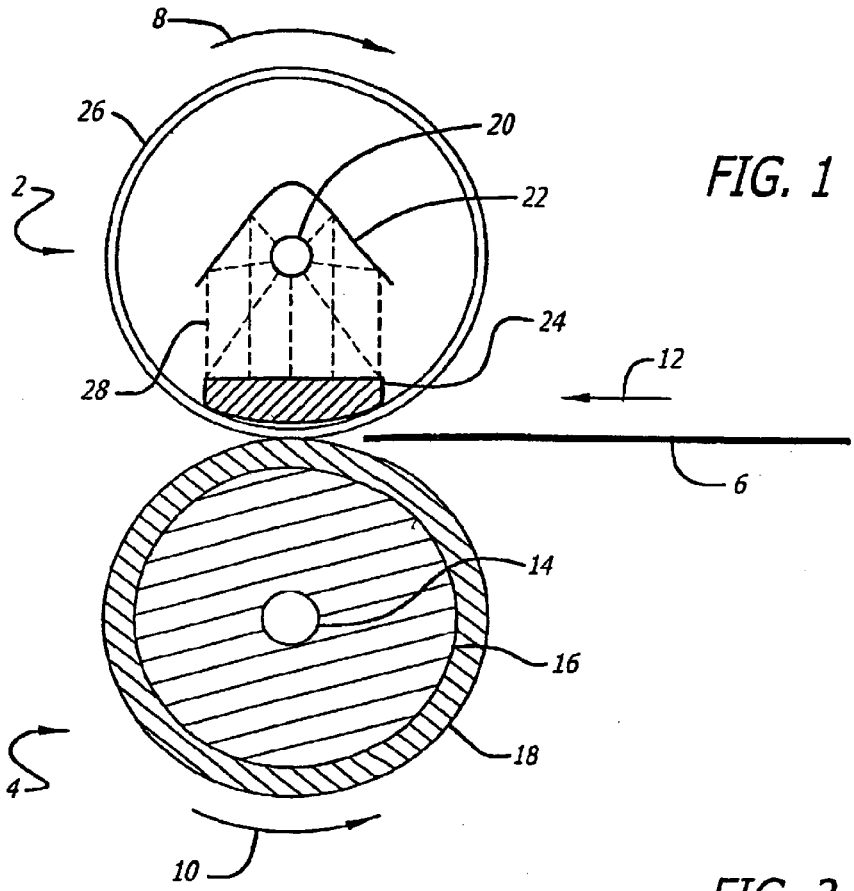
FIG. 1
FIG. 2
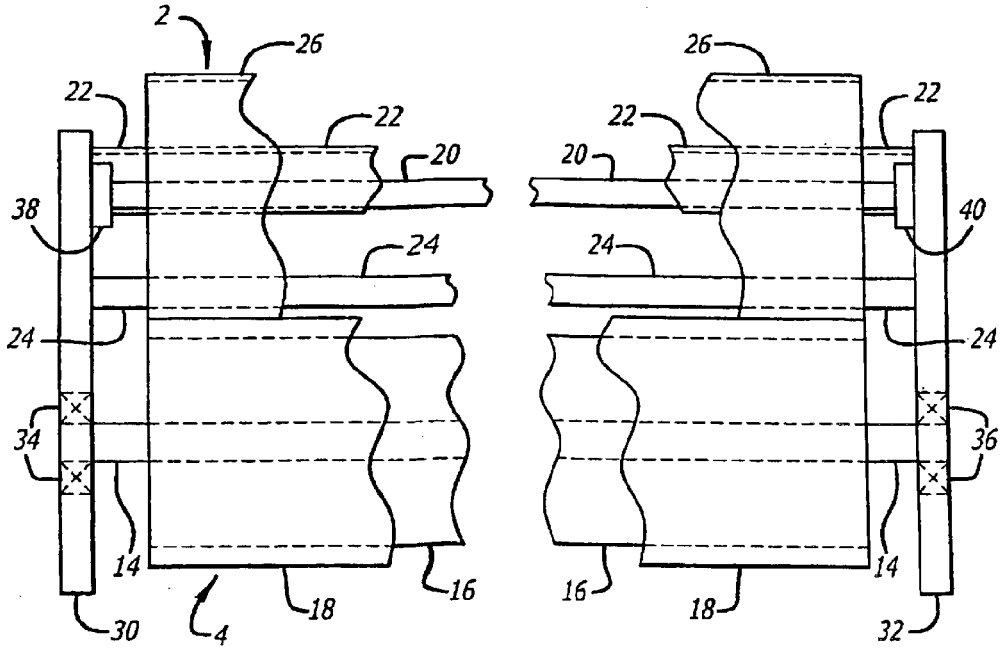

SYSTEM AND METHOD FOR UTILIZING A USER NON-PERCEIVABLE LIGHT SOURCE IN A MACHINE

This application is a divisional of U.S. application Ser. No. 10/081,370, filed Feb. 22, 2002, now U.S. Pat. No. 6,649,874.

BACKGROUND OF THE INVENTION

1. Field of the Invention

The present invention relates to machines, including laser imaging and printing devices. More specifically, the present invention relates to toner-media fusing units used in laser imaging and printing devices and the use of the user non-perceivable light sources therein.

2. Description of the Related Art

Laser printers and other imaging devices that employ toner transfer and toner fusing technology all rely upon a fusing unit to adhere toner particles, which form the image, to some type of media, such as paper. The fusing operation makes the toner-transferred image durable and permanent. Techniques used for toner fusing employ heat and pressure to fuse the toner particles to the media. Current fusing technologies employ a two-roller arrangement that utilize a pressure roller and a heating (or fusing) roller. The two rollers are urged together with a predetermined amount of force. At least one of the rollers is driven to rotate. The combined pressure and rotation of the two rollers pinch and convey the media while heat and pressure serve to fuse the toner particles to the media.

There are two dominant technologies applied in fusing units. Both utilize a pressure roller and fusing roller. Typically, the fusing roller is located relative to the side of the media upon which the toner particles are deposited. Both rollers have a length at least as long as one of the media dimensions. In both technologies, the pressure roller consists of a rigid core, followed by a rubber or rubber-like covering that is coated with a release compound. The release coating prevents residual toner adhering to the fusing film from transferring to the pressure roller and thereby being inadvertently transferred to the back side of the media during subsequent print jobs. The pressure roller brings physical pressure against the fusing roller. The pressure is typically produced using spring force. In operation, toner is deposited on the media, which is usually paper, in advance of the fusing operation. The media is urged toward the pinch point of the pressure roller and fusing roller. The flattened area between the rollers is referred to as the nip of the rollers by those skilled in the art. As the media traverses the rollers, heat and pressure fuse the toner to the page. In a typical letter-sized paper printer, the fusing temperature is in the 150–200° C. range and the force applied to the pressure roller is in the 10–15 kilogram force range for 9 inch pressure rollers.

In the first of the two dominant technologies, a ceramic heating element is used to heat the fusing roller. The ceramic heating element is a resistive heating element that is adhered to a ceramic substrate that has a long and narrow configuration. It produces the required fusing heat. The ceramic heating element is supported by a fixed and rigid support structure, usually fabricated from sheet metal, inside of the fusing roller covering. The ceramic heating element and its support structure do not rotate. The fusing roller is a flexible, tubular shaped structure formed from a suitable fusing roller material. The basic circular shape of the flexible fusing roller/film is maintained by the fixed and rigid support structure and the ceramic heater. The fusing roller covering does rotate in synchronous with the pressure roller. The fusing roller material has certain physical, electrical, and thermodynamic characteristics, which are appreciated by those skilled in the art. In particular, the material possesses good heat transfer characteristics, has a smooth exterior finish so that particles are not captured by its surface, can withstand the heat used in the fusing operation, and has electrostatic and other electrical properties consistent with the general principles of electrostatic toner management. Such principles are understood by those skilled in the art. Mylar, Polyester, and Polyamide materials coated with Teflon and TFE thermoplastics are suitable fusing roller materials, for example. The outer surface of the fusing roller contacts the media at the pinch point with the pressure roller. The ceramic heating element contacts the interior surface of the fusing roller at the same position as the media contacts the exterior surface. The fusing roller material is thin, which is useful to provide good heat transfer characteristics. The dominant heat transfer mechanism in a ceramic heater fusing unit is thermal conduction.

The second of the two dominant fusing technologies employs a bulb heating element instead of a ceramic heating element. The second dominant technology uses the same type of pressure roller. The fusing roller for a bulb heating element employs a rigid metallic tube to form the roller, which may be fabricated from aluminum or other suitable metal. The roller is covered with a fusing film that is adhered directly to the surface of the metallic tube. The fusing film has essentially the same physical, mechanical, and thermodynamic characteristics as the aforementioned fusing roller material. The fabrication process differs because the film is applied to a rigid metal tube. A long light bulb is disposed within the fusing roller tube. The light bulb produces visible light and radiant heat when it is energized. The metallic tube and fusing film rotate, while the bulb heater does not rotate. The light and heat couple to the inside surface of the metallic tube. The principle coupling mechanism is thermal radiation. The metal tube then conducts the heat through the roller to the media as it traverses the pinch point between the fusing roller and the pressure roller. In a letter-sized paper printer, the light bulb heating element is approximately 8–9 inches long and about ¼" in diameter. The bulb comprises several filaments, each about an inch long.

While both of the ceramic heater and bulb heather fusers perform the desired fusing function in a toner imaging device, there are significant design trade-offs between the two. Bulb heaters are characterized by lower cost, often better robustness and reliability, and longer warm-up times. Ceramic heaters are characterized by higher cost and shorter warm-up times. The brittle nature of ceramic, along with its other mechanical properties, may result in reliability issues in some ceramic heater designs. This is due to the stresses of temperature cycling over many print jobs and the high pressures imparted by the pressure roller onto the ceramic substrate. The desire for low cost and high reliability is an obvious design choice. The desire for short warm-up time involves two concepts. First is the desire to reduce power consumption of the imaging device. The fuser heater draws a large amount of power, so it is very desirable to shut the heat off during idle periods. This implies that the fuser heater must warm-up prior to each printing operation. Thus, there is a desire to produce a short fuser heater warm-up time so that the time duration to the first page output after a printing operation is initialized is as short as possible. This is known as the "time to first page out" by those skilled in the art. In fact, the time to first page out is an important perceptual aspect of the apparent performance of a laser-imaging device in the minds of consumers. Modern ceramic heater fuser devices achieve a time to first page out on the order of 10 seconds from a cold start. Bulb heater fuser devices have times to first page out in the 20–50 second range from a cold start.

Thus, it can be appreciate that there is a need in the art for an apparatus and method that uses lower cost bulb heater fusers while maintaining the performance and low time to first page out of ceramic-based fusers.

Further, as is well known in the art, laser print engines are utilized in a variety of machines, multi-function peripheral devices, and other business, office and home imaging machines. These machines typically include control panels, indicators and other user interface components, many of which are, or could be, illuminated. In fact, industrial designers of the aforementioned machines frequently prefer to use illumination to achieve industrial design objectives. Such objectives may include functional and/or stylistic design criteria. Process status indicators are an example of illuminated user interface components. Back-lit manufacturer logotypes are an example of an illuminated industrial design stylistic feature. Illuminated components are more readily noticed and identified by users than are non-illuminated components. Illuminated components enhance operation of a device where low ambient light levels exist. Illuminated components attract attention, which may be useful in achieving sales and marketing objectives.

While illuminated components are desirable from functional and stylistic perspectives, they add to the cost of the machine into which they are incorporated. The added cost must be balanced against the benefits realized. The addition of illuminated components to a machine requires the addition of a light-producing device, such as a light emitting diode, incandescent lamp, of other light-producing component. There is also a requirement to couple power to the light-producing device, either through wiring or printed circuitry. In addition, there is frequently a need to selectively activate the light-producing component, which can create a need to interface the control of the light-producing device to a controller of some type. At the least, the light-producing device needs to be switched on and off with the machine itself.

Virtually all laser-printing engines incorporate a fusing assembly, which applies heat and pressure to fuse a toner image to the media in the printing process. Heat is produced within the fusing assembly by an electric heater. Modern laser printing engines usually employ either a ceramic heating element or a bulb-heating element. Ceramic heaters include a resistive heating element that produces heat, which is conducted to the media for the fusing operation. Bulb heating elements produce radiant energy in the infrared and visible spectrums that is radiated from the bulb heater to the other portions of the fusing assembly where the energy is converted to heat used in the fusing operation. The fusing assembly is located within the laser printing engine and is typically sealed to reasonably prevent the escape of the fusing energy from the fusing assembly to other areas of the laser print machine. The light produced by bulb heating elements is thus user non-perceivable.

It can be appreciated that visable spectrum light is utilized within the laser printing engine of the aforementioned machines which employ bulb-heating elements. There are other imaging machines that utilize visible light sources in their processes as well. Photo-imaging machines, such as copiers, image scanners and other machines use internal visible spectrum light sources in their processes.

Given the design incentives to incorporate illuminated components into machines, there is a need in the art for a system and method for utilizing existing user non-perceivable visible light sources within imaging machines for the purpose of illuminating user interface control panels, indicators and other user interface components.

SUMMARY OF THE INVENTION

The need in the art is addressed by the systems and methods of the present invention. An illustrative embodiment teaches a fusing unit for fusing toner to media. The fusing unit includes a heating element that produces radiant energy and a thermal spreader that converts the radiant energy into heat that is used to fuse the toner to the media. The unit also includes a reflector that is positioned to reflect a portion of the radiant energy toward the thermal spreader. The heating element may be a bulb type heater or a ceramic element heater. The reflector may include a paraboloidal surface positioned to concentrate a portion of the radiant energy toward the thermal spreader. The reflector may be smooth or facetted. In a particular embodiment, the reflector is parabolic and positioned with the heating element as its focus. In another embodiment, the reflector is a paraboloidal trough and the heating element is linear and positioned along the focal line of the paraboloidal trough.

In a refinement of the invention, a fusing film is disposed between the thermal spreader and the media. The fusing film may be a thermoplastic, such as Mylar coated with Teflon. In another embodiment, a fusing toller is added with the heating element, the thermal spreader, and the reflector disposed within the fusing roller. The fusing roller may be rotatably supported and the heating element, the thermal spreader, and the reflector fixed against rotation. A pressure roller can be added which is supported to urge the media against the fusing roller. The rollers may be driven to rotate and advance the media through the fusing unit.

A system for utilizing light produced by a non-perceivable light source in a machine is also taught by the present invention. The system included a mechanism for conveying the light from the user non-perceivable light source to a particular location within the machine and a component positioned at that location to receive the light. The component operates to utilize the light in a user perceivable manner. In one embodiment, the machine includes an opaque enclosure, and the mechanism for conveying light is unobstructed pathway from the non-perceivable light source to the location. The component is positioned at an opening in the opaque enclosure. The mechanism to convey light can also be a reflective surface that directs the light towards the location, or a light pipe, or a fiber optic.

In a refinement to the foregoing invention, the mechanism for conveying light conveys light intermittently. This can be accomplished where the machine includes a device characterized by periodic motion, so that the mechanism for conveying light can convey light intermittently according to the periodic movement of the device characterized by periodic motion. In other refinements to the invention, the components may be translucent, or may be a logo or user interface indicator.

In a particular embodiment, a printing device that employs the advancement of the present invention is taught. The printing device includes a fusing unit that has a bulb heater that emits user non-perceivable light and mechanism for conveying the light from the bulb heater to a location within the printing device. Also, a component positioned at the location to receive the light conveyed by the mechanism for conveying light and the component operates to utilize the light for illumination thereof in a user perceivable manner.

BRIEF DESCRIPTION OF THE DRAWINGS

FIG. 1 is a cross-section of a fusing unit according to an illustrative embodiment of the present invention.

FIG. 2 is a diagram of a fusing unit according to an illustrative embodiment of the present invention.

DESCRIPTION OF THE INVENTION

Figure 3B:
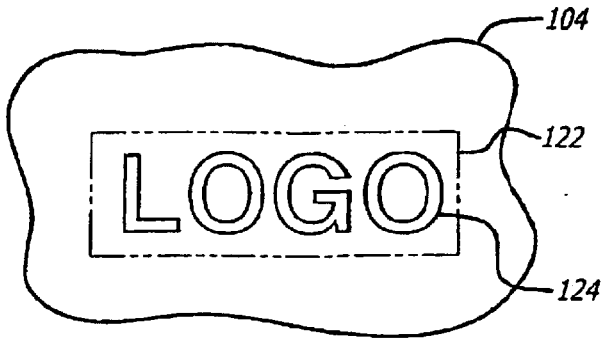
FIG. 3B is a detail view of an illuminated user perceivable component according to an illustrative embodiment of the present invention.

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention teaches and improved fuser for laser imaging systems including laser printers. The fuser unit includes a pressure roller and a fusing roller that operate as a pair or pinch rollers to both convey media and to fuse toner to the media using heat and pressure. In an illustrative embodiment, a parabolic (or other geometrically shape) light and radiant energy concentrating reflector is employed. A bulb heater emits radiant energy in the form of visible and infrared energy that is reflected and concentrated by the reflector. The radiant energy is concentrated by the reflector and directed to a thermal spreader that converts the radiant energy to heat energy and conducts the heat to the point of the fusing operation. The thermal spreader is fabricated from a material that preferably has low specific heat and high thermal conductivity. Certain metals, such as copper and certain ceramic materials may be suitable for use as a thermal spreader. A tubular fusing film (The fusing roller) surrounds the bulb heater, reflector, and thermal spreader. The thin, flexible film is formed from a thermoplastic, such as Mylar coated with Teflon, to provide a suitable surface finish for contact with the media and toner. Such surface characteristics are known to those skilled in the art. The fusing film is supported by a sheet metal structure that serves to form the fusing roller structure. The thermal spreader is urged against the inside surface of the fusing film at the point where the pressure roller engages the fusing roller. Heat is conducted from the thermal spreader, through the fusing film and to the toner and media, which are pinched between the two rollers.

The bulb heater emits radiant energy in an omnidirectional manner. The prior art fusing rollers dealt with this fact by surrounding the bulb heater with a metallic tube roller to absorb the omnidirectional radiant energy. This yielded a fusing roller with a relatively large thermal mass and a correspondingly long warm-up lag time. The present invention advances the art by concentrating the omnidirectional radiant energy with a reflective surface thereby focusing the radiant energy to a small portion of the omnidirectional arc where the thermal spreader is positioned. The thermal spreader has a correspondingly lower thermal mass, and hence a shorter warm-up lag time than the prior art metallic tube roller. The shorter warm-up lag time leads to a shorter time to first page out for the imaging device. The net result is that the bulb heater fuser can provide "instant-on" operation in the imaging device. The cost issues existing in the prior art are addressed as well. The use of a low cost bulb heater holds production cost down, while the aforementioned advances in the art provide a time to first page out performance rivaling ceramic heater products.

The illustrative embodiment utilizes a parabolic trough reflector, reminiscent of the parabolic trough solar water heaters. The bulb heater is placed at the focal line of the parabolic trough and the omnidirectional radiant energy is reflected out of the parabolic trough to a limited area where the thermal spreader is positioned. While a parabolic section is utilized in the illustrative embodiment, those skilled in the art will appreciate that any paraboloidal section could be utilized, including semi-circular sections, parabolic sections, elliptical sections, and hyperbolic sections. The reflective surface may be smooth, closely following the mathematical contour of the paraboloidal section, or can be facetted to more coarsely follow that contour. For example, two mirrors held at a right angle could serve as the reflector/concentrator.

In the illustrative embodiment, the thermal spreader, reflector and bulb remain in a fixed position as the outer fusing film tube (the fusing roller) rotates against the pressure roller. The thermal spreader can thus be placed to the pressure roller (opposite the fusing film) and remain fixed as the rollers rotate to pinch and fuse the toner to the media. The fusing film rotates around a fixed mechanical structure that supports the bulb heater, reflector, thermal spreader, and fusing film. In the illustrative embodiment, the pressure roller is the driven roller with friction causing a traction effect to drive the fusing film/roller to rotate in synchronous therewith. Of course, the fusing roller film is preferably thin to promote conduction to the media and to maintain a low thermal mass. It is preferably fabricated from a material having low specific heat. A thermoplastic material, for example, Mylar coated with Teflon, is used in the illustrative embodiment.

Since the outer surface of the thermal spreader slideably engages the inside surface of the fusing roller, it is necessary to apply a low friction finish to the thermal spreader, and to configure the physical dimension of that surface to conform to the roller's shape as it operates. While the fusing roller film is round while it is in a relaxed position, its shape changes when it is pinched against the rubber-like surface of the pressure roller. In fact, the shape of the fusing roller is somewhat flattened by the ten to fifteen kilograms of force exerted by springs to pinch the rollers together. Thus, the outside surface of the thermal spreader is slightly flattened in the area of the nip of the rollers and the pressure area between the rollers.

Reference is directed to FIG. 1, which is a cross section view of a fusing unit according to an illustrative embodiment of the present invention. A pressure roller 4 is rotatably supported on a shaft 14. A solid core 16 supports a rubber or rubber-like surface material 18. The solid core 16 may be aluminum or a rigid plastic material, for example. This core is followed by rubber-like material which is coated with a release compound. Those possessing ordinary skill in the art will appreciate that a conventional pressure roller design is applicable to the present invention. The fusing unit also includes a fusing roller assembly 2. A bulb heater 20 is located near the center of the fusing roller assembly 2. The bulb heater 20 is of conventional design and is generally configured to be long and narrow, having a length approximately equal to the length of the fusing roller assembly 2. The power output of the bulb heater 20 is sized to produce a fusing temperature at the roller pinch point of approximately 150–200 degrees Celsius during operation.

A parabolic trough reflector 22 is positioned about the bulb heater 20 such that the bulb heater 20 lies along the focal line of the parabolic trough reflector 22. Radiant energy 28 is emitted and reflected from the bulb heater 20 and reflector 22 respectively. The radiant energy is thus concentrated to a limited arc of the omnidirectional pattern it was initially emitted about. A thermal spreader 24 is positioned at that arc and is approximately as long as the bulb heater 20 and fusing roller assembly 2. The concentrated radiant energy 28 is absorbed by the thermal spreader 24 and converted to heat energy for conduction to the fusing operation. A fusing roller/film 26 is disposed about the bulb heater 20, the reflector 22 and the thermal spreader 24. There may be support structure within the fusing roller 26, although no structure appears in the illustrative embodiment as all the items, with the exception of the fusing roller film, are designed to be self-supporting. It is conceived that some supporting structure, whether unique or provided in part by the aforementioned items, would act to support the thin, flexible fusing roller/film.

The pressure roller 4 is driven to rotate 10. While the fusing roller 26 is illustrated in its relaxed position in FIG. 1, spring force is applied to urge the two rollers together during operation. Thus, the driven pressure roller 4 engages the fusing roller 26 to drive it to rotate 8 in synchronous therewith. The small gap illustrated between the thermal spreader 24 and the fusing roller 26 is compressed during operation. The surface profile of the thermal spreader 24 surface follows the contour of the compressed rubber-like surface 18 of the pressure roller 4 during operation. During operation, media 6 is urged toward 12 the nip of the rollers 4 and 26. Once engaged with the pinch point between the rollers, the media 6 is conveyed through the rollers, where the heat and pressure fuse the toner to the media 6.

Reference is directed to FIG. 2, which is a partially cutaway side view diagram of the fusing unit in the illustrative embodiment of the present invention. The pressure roller 4 and fusing roller assembly 2 are illustrated in operating position and supported by support structures 30 and 32, which are located at the two ends of the rollers. The pressure roller 4 is rotatably support by its support shaft 14 and two bearings 34 and 36, which are mounted to support structures 30 and 32 respectively. The shaft 14 supports the rigid core 16 of the pressure roller 4, which has the rubber or rubber-like outer surface 18 disposed thereon.

The fusing roller assembly 2 includes the fusing roller/film 26 that engages the pressure roller 4. The thermal spreader 24, the parabolic trough reflector 22, and the bulb heater 20 are disposed within the fusing roller 26. In the illustrative embodiment, the thermal spreader 24 extends all the way through the fusing roller 26 and is rigidly affixed to both of the support structures 30 and 32. An insulative support abutment (not shown) may be used to thermally isolate the thermal spreader 24 from the support structures 30 and 32. The parabolic trough reflector 22 extends though the ends of the fusing roller 26 and is rigidly affixed to the support structures 30 and 32. The bulb heater 20 also extends through the ends of the fusing roller 26 where a pair of electrical sockets 38 and 40 are attached to support structures 30 and 32 respectively to support and provide electric current to the bulb heater 20. In the illustrative embodiment, the pressure roller 4 shaft 14 is motor driven (not shown) to drive the fusing unit to fuse toner to media, as described herein above.

As noted above, the fusing roller has a bulb heater inside, which emits visible and infrared light. In addition to providing the fusing heat, some of the light emitted from the bulb heater passes through a translucent outer fusing film of the fusing roller to illuminate a logo, accent line, user interface component, or other feature of the machine. In addition to the direct transmission of light through the translucent fusing film, light can be directed to the illuminated component through a number of other means. Such means may include small transparent apertures in an otherwise opaque fusing film that allows light from the bulb heater to be conveyed directly or via a light pipe to the illuminated component. Designing a series of light apertures in the rotating fusing roller creates a flashing effect. In the case of an opaque fusing roller/film, light can also be conveyed through an open end of the fuser to the illuminated object. This can be effectuated by direct radiation, or through reflection or transmission in a light pipe or fiber optic.

Generally stated, the fuser bulb heater is a user non-perceivable light source within the laser printing machine. In operation, the fusing roller rotates together with the aforementioned pressure roller, and the media traverses therebetween during the fusing operation. Within the fusing roller is a light bulb (the bulb heater) that radiates energy used for the fusing operation. In the prior art, the light emitted from the bulb heater has been fully confined within the fusing roller and used only to provide fusing heat. The present invention advances the art by teaching the use of different means for conveying a portion of the user non-perceivable light from the bulb heater to another location within the machine. The conveyed light is used to illuminate a component that is positioned in a user perceivable position. Thus, the conveyed light is used to illuminate an industrial design element, or user interface component on the machine. This can be done using direct illumination, side-lighting, back-lighting, and other lighting techniques known to those skilled in the art.

In one embodiment, there is a direct transmission of light from the bulb heater through an unobstructed pathway to the illuminated component, which is based on a close proximity between the illuminated component and the bulb heater. In a particular embodiment, a portion of the length of the bulb heater extends beyond the length of the fusing roller, and can be used as a source for directly, or indirectly conveying light from the bulb heater. If the position of the illuminated component is such that it does not lend itself to direct conveyance of light, then indirect light conveyance means are employed. The bulb heater light can be conveyed directly through a translucent fusing roller. In the prior art, many fusing rollers were constructed of opaque material. In such a case, a small annular translucent portion can be fabricated into the fusing roller so that light can be conveyed continuosly there through as the roller rotates. In embodiments that do not lead themselves to direct conveyance of light, indirect conveyance techniques are employed.

Indirect conveyance of light from the user non-perceivable bulb heater to the illuminated component can be achieved using reflective surfaces positioned to direct the light to a location where the illuminated components is positioned. In addition, the present invention teaches the use of light pipes and fiber optics to achieve indirect conveyance of light. Various direct and indirect conveyance means can be combined to achieve the desired result of conveying light to the location of the illuminated component.

The illuminated components can be many, varied and diverse as are now known or that later become known to those of ordinary skill in the art. An illustrative embodiment is directed to a back-lit manufacturer's logotype that is placed in the outer casing of the machine. Other components could be illuminated as well, including but not limited to, user controls, printed instruction materials, passive and electronic displays, accent and highlighted design elements, indicators, and other components. It will be appreciated that plural light conveyance means can be applied to a single user non-perceivable light source so that the multiple components can be simultaneously illuminated.

The fact that the fusing roller rotates during operation is advantageously applied to an illustrative embodiment of the present invention. The rotation of the fusing roller is combined with a plurality of apertures or a rotating star-wheel to cause the intermittent conveyance of light. As the tube rotates, the apertures, or fingers of the star wheel pass between the light source and the means for conveying light to intermittently allow the conveyance of light. The net result is that the illuminated component is intermittently illuminated according to the size of the apertures/fingers, and the speed at which the fusing roller rotates. Of course, this concept can be applied to other machines that employ linear and other movement, as well as rotational movement.

Figure 3A:
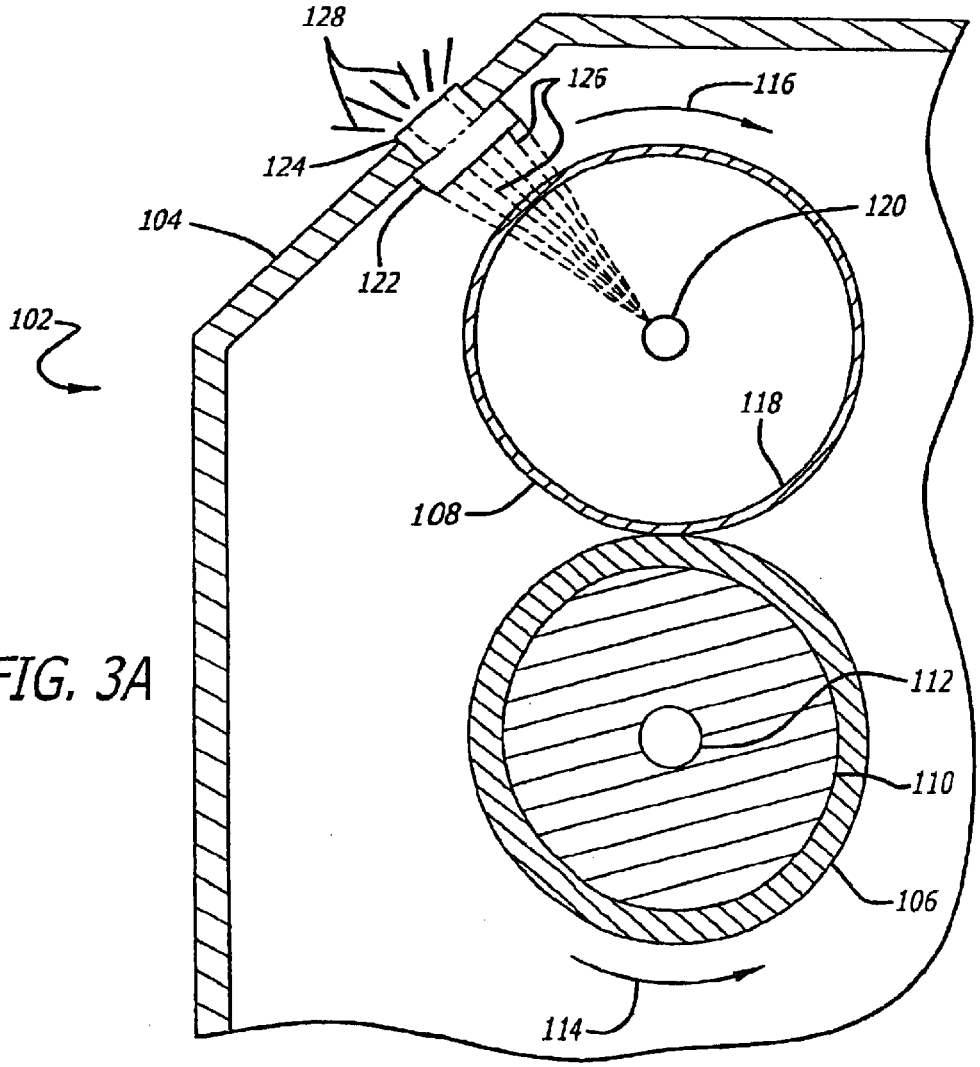
FIG. 3A is a section view of a printing device according to an illustrative embodiment of the present invention.

Reference is directed to FIG. 3A, which is a section view of a printing device 102 according to an illustrative embodiment of the present invention. The printing device 102 is a laser printer in the illustrative embodiment, and is enclosed by enclosure 104. Within enclosure 104 is a fusing unit that comprises a pressure roller 106 and a fusing roller 108. The pressure roller 106 is supported on a shaft 112 that is rotatably supported by bearings (not shown). A rigid core 110 supports the rubber-like outer surface of the pressure roller 106. The pressure roller 106 is driven to rotate 114 by an electric motor (not shown). The pressure roller 106 rotatably engages the fusing roller 108 causing the fusing roller 108 to rotate 116 in synchronous with the pressure roller 106.

A bulb heater light bulb 120 is disposed within the fusing roller 108. The bulb heater 120 is supported in a fixed, non-rotating, position by a pair of light sockets (not shown) attached to the printer 102 chassis (not shown). The fusing film/roller 108 is fabricated from a suitable fusing film 118. Fusing units generally, and pressure rollers and fusing rollers particularly, are known to those skilled in the art. So too are fusing film materials and bulb heater light bulb elements. The bulb heater 120 emits radiant energy in the form of visible and infrared light. In the prior art, this energy was fully confined within the fusing roller 108, where it was converted to heat used in the fusing operation. Thus, the radiated energy in prior art fusing units was user non-perceivable. The illustrative embodiment of the present invention illustrated in FIG. 3A employs a translucent fusing film 118 for at least a portion of the length of the fusing roller 108. Because of this translucent characteristics, a portion of the length of the radiated from the bulb heater 120 passes through the fusing roller 118 and travels 126 directly to a location in the inside of the printer enclosure 104. The path that the light follows 126 is unobstructed since the fusing roller and the enclosure are in close proximity in the illustrative embodiment. At the location inside the enclosure 104 that the light is conveyed to, a translucent, back-lit logotype component 122 is placed in an opening in the enclosure. Light 126 that impinges the back of the logo 122 is coupled through the logo style 128 and is dispersed 128 outside of the enclosure 104 in a user perceivable manner. FIG. 3B is a detail view of the illuminated user perceivable component (the "LOGO") 122 according to the illustrative embodiment of the present invention in FIG. 3A. The logo style 124 extends through the enclosure 104 through an opening in the enclosure that corresponds to the shape of the logo style 122. Light that strikes the location of the logo 122 is thus conveyed to the outside of the enclosure 104, in a user perceivable manner.

Figure 4:
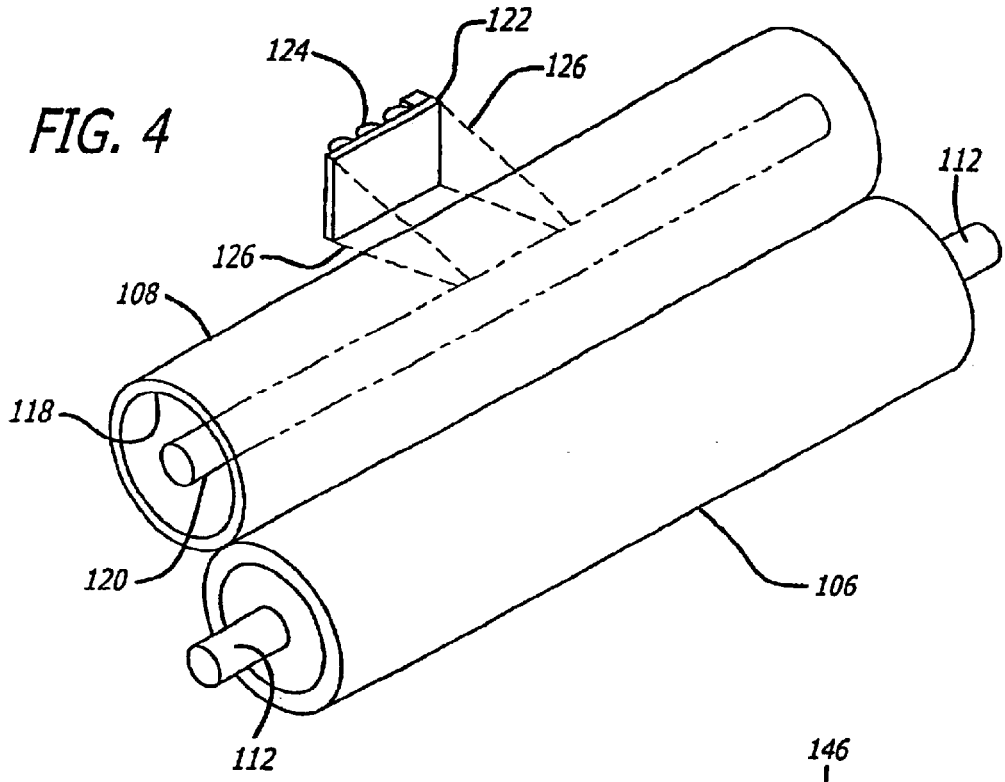
FIG. 4 is a perspective view of an illustrative embodiment of the present invention.

Reference is directed to FIG. 4, which is a perspective view of the illustrative embodiment of the present invention depicted in FIGS. 3A and 3B. In FIG. 4, the case 104 is omitted from the view to aid in clarity. The pressure roller 106 has its support shaft 112 extending from both ends. As noted above, the shaft 112 is supported on bearings (not shown). The fusing roller 108 engages the pressure roller 106. Within the fusing roller 108 is the bulb heater 120. Note that the bulb heater 120 generally extends for a length approximately equal to the length of the fusing film 118. Light rays 126 radiate from the bulb heater 120 and pass through the translucent portion of fusing film 118. The light rays travel to the location of the logo 122 and pass through the translucent logo material to the logo style, where the light becomes user perceivable, as an illuminated logotype.

The means for conveying the bulb heater 120 light is by direct radiation and relies on a close proximity between the fusing unit and the location on the enclosure where the logo 122 is placed. The path of the light 126 needs to be unobstructed to the passage of light for this embodiment to function. It should also be noted that any photo-sensitive components in the laser printer, the photoconductive drum in particular, must be shielded from the radiation of light through the translucent fusing film 118 employed in the present invention. This aspect applies to all of the embodiments.

Figure 5:
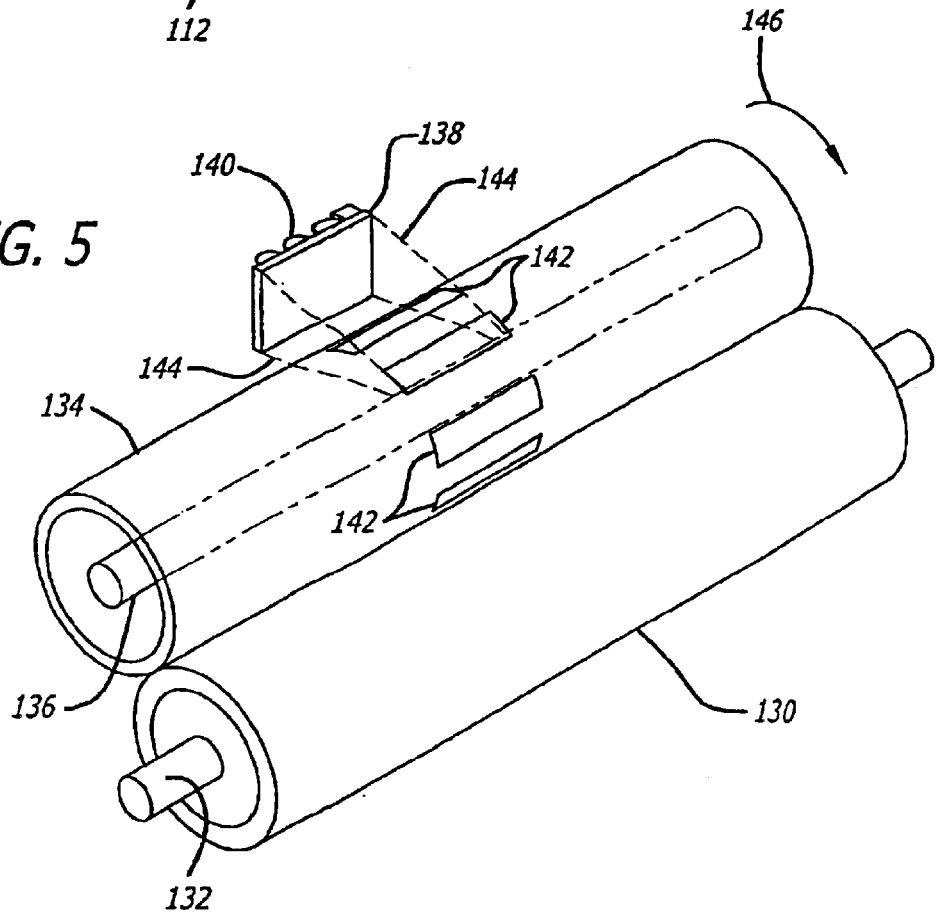
FIG. 5 is a perspective view of an illustrative embodiment of the present invention.

Reference is directed to FIG. 5, which is a perspective view of an illustrative embodiment of the present invention that employs the aforementioned intermittent or pulsating illumination. The illustrative embodiment in FIG. 5 is also a laser printing device the employs a fusing unit. The fusing unit has a pressure roller 130, which is rotatably supported by shaft 132. The pressure roller 130 engages the fusing roller 134 and induces rotation 146 of the fusing roller 134. The fusing roller has a bulb heater 136 disposed within it, which radiates visible light. The fusing roller is opaque to the transmission of light, except for a series of apertures 142 that are formed from a translucent material. As the fusing roller rotates 146, the translucent apertures 142 pass between the bulb heater 136 and the location of a logotype 138. The light 144 radiated from the bulb heater 136 is thus intermittently conveyed at a repetition rate and period according to the size of the apertures 142 and the speed of rotation 146 of the fusing roller. The light 144 impinges that back of the logo style 140 on the exterior of the enclosure (not shown) in a user perceivable fashion. The illumination of the logo is intermittent and pulsates, which is useful to draw attention to the logo by users in the area of the laser printer.

Figure 6:
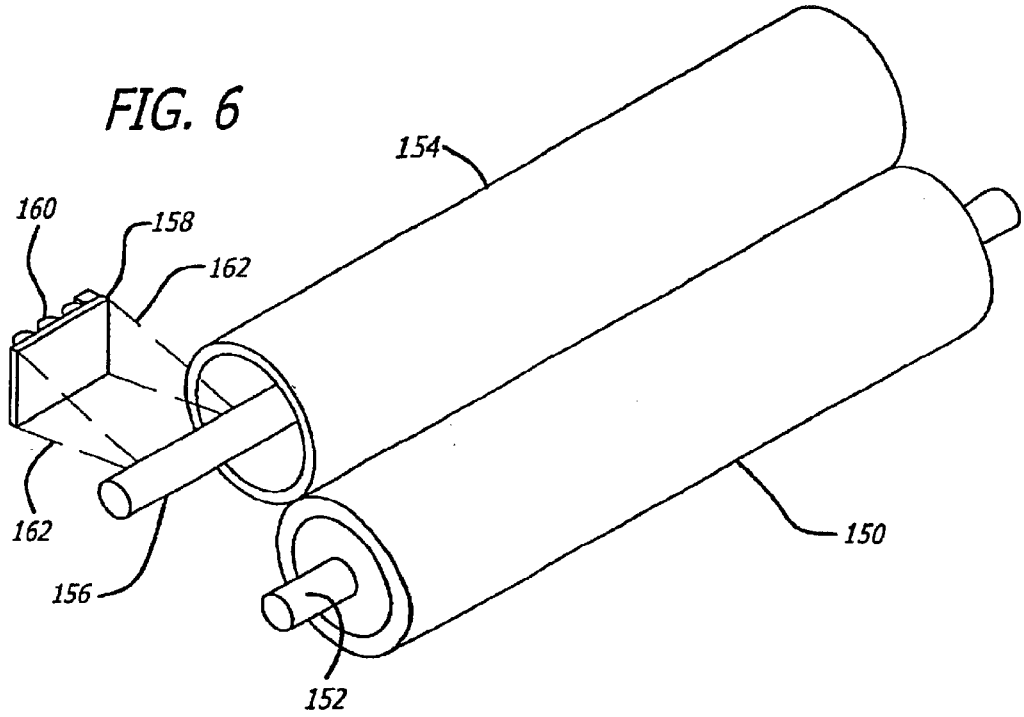
FIG. 6 is a perspective view of an illustrative embodiment of the present invention.

Reference is directed to FIG. 6, which is a perspective view of an illustrative embodiment of the present invention.

The illustrative embodiment in FIG. 6 is also a laser printing device that employs a fusing unit. The advancement taught in FIG. 6 is the extension of the bulb heater from the end of the fusing roller to allow access to the radiated light for conveyance to the location of the illuminated component. More particularly, the fusing unit has a pressure roller 150, which is rotatably supported by shaft 152. The pressure roller 150 engages the fusing roller 154. The fusing roller 154 has a bulb heater 156 disposed within it, which radiates visible light. The fusing roller is opaque to the transmission of light. To enable conveyance of light away from the opaque fusing roller, the bulb heater 156 is linger than the fusing roller 154 and extends from one end thereof. The light 162 radiated from the extended end of bulb heater 156 is thus conveyed to the location of the logotype 158. The light 162 impinges that back of the logotype 158, which is formed from a translucent material. The light is coupled to the logo style 160 on the exterior of the enclosure (not shown) in a user perceivable fashion.

Figure 7:
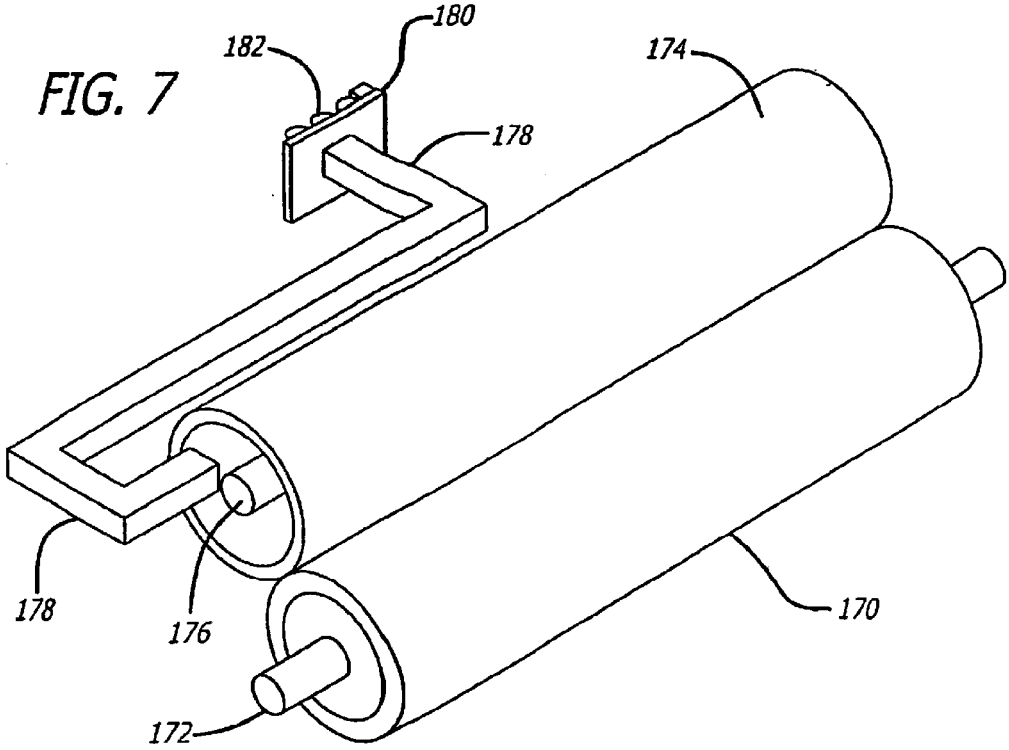
FIG. 7 is a perspective view of an illustrative embodiment of the present invention.

Reference is directed to FIG. 7, which is a perspective view of an illustrative embodiment of the present invention. The illustrative embodiment in FIG. 7 is also a laser printing device that employs a fusing unit. The advancement taught in FIG. 7 deals with indirect conveying of light through the use of light pipes or fiber optics. The fusing unit has a pressure roller 170, which is rotatably supported by shaft 172. The pressure roller 170 engages the fusing roller 174. The fusing roller has a bulb heater 176 disposed within it, which radiates visible light. The fusing roller 174 is opaque to the transmission of light, except for openings at the two ends of the fusing roller 174.

Since there is no direct, unobstructed, passage for light to travel from the bulb heater 176 to the location of the logo 180, a light pipe (or fiber optic) 178 is employed. Light radiates from the end opening of the fusing roller 174. A first end of the light pipe 178 is positioned to receive light from the bulb heater 176. Light is conveyed through the light pipe 178 to its second end. The logo 180 is coupled to receive the light conveyed through the light pipe. The light impinges that back of the logotype 180, which is formed from a translucent material. The light is coupled to the logo style 182 on the exterior of the enclosure (not shown) in a user perceivable fashion. The light pipe (or fiber optic) 178 can be configured in a great variety of shapes to accommodate a great variety of indirect conveying means.

Figure 8:
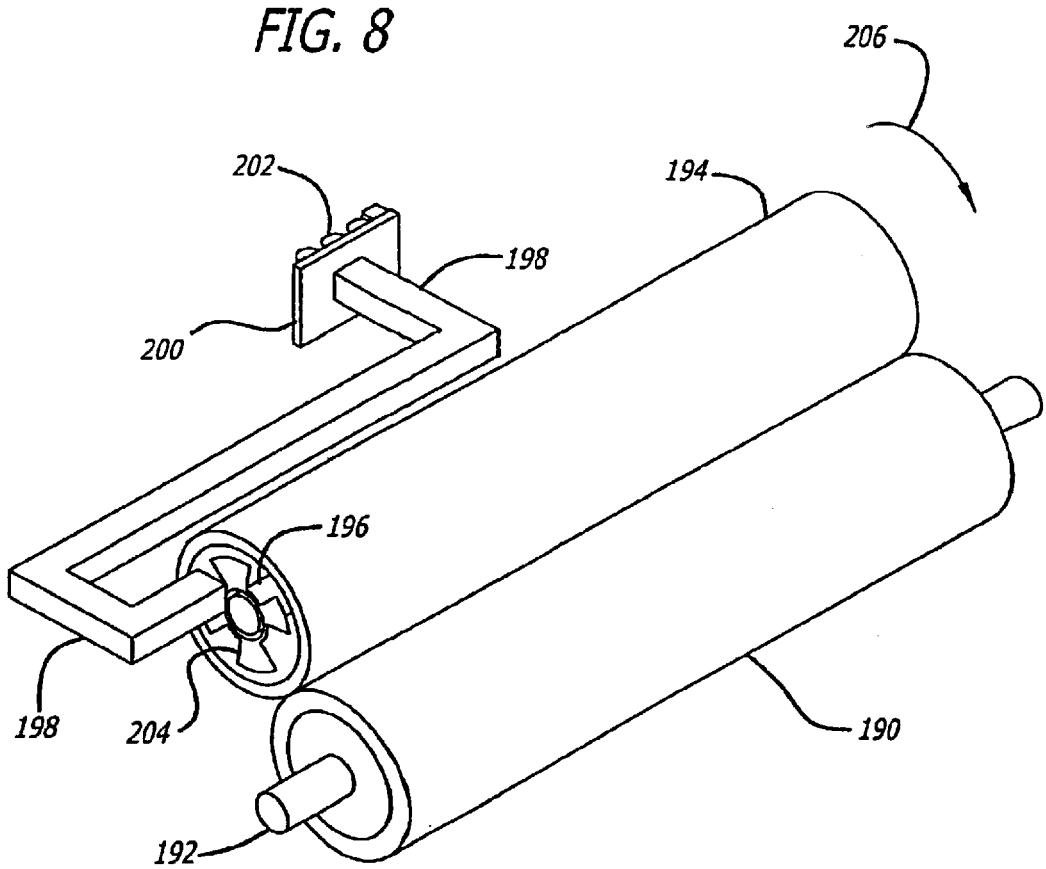
FIG. 8 is a perspective view of an illustrative embodiment of the present invention.

Reference is directed to FIG. 8, which is a perspective view of an illustrative embodiment of the present invention. The illustrative embodiment in FIG. 8 is also a laser printing device that employs a fusing unit. The advancement taught in FIG. 8 deals with indirect conveying of light through the use of a light pipes or fiber optics, and the implementations of an intermittent, or pulsating light source. The fusing unit has a pressure roller 190, which is rotatably supported by shaft 192. The pressure roller 190 engages the fusing roller 194 has a bulb heater 196 disposed within it, which radiates visible light. The fusing roller is opaque to the transmission of light. The fusing roller 194 is opaque to the transmission of light, except for openings at the two ends of the fusing roller 194. Since there is no direct, unobstructed, passage for light to travel from the bulb heater 196 to the location of the logo 200, a light pipe (or fiber optic) 198 is employed. Light radiates from the end opening of the fusing roller 194. A first end of the light pipe 198 is positioned to receive light from the bulb heater 196. Light is conveyed through the light pipe 198 to its second end. The logo 200 is coupled to receive the light conveyed through the light pipe 198. The light impinges that back of the logotype 200, which is formed from a translucent material. The light is coupled to the logo style 202 on the exterior of the enclosure (not shown) in a user perceivable fashion. The illustrative embodiment in FIG. 8 adds a star wheel 196, which is coupled to and rotates in synchronous with the fusing roller 194. Fingers on the star wheel 196 intermittently block the end of light pipe 198 from receiving light from the bulb heater 196. Thus, the duration and period of the intermittent light is defined by the size of the finger and the speed at which the fusing roller rotates.

The illustrative embodiments deal with laser printers as the type of machine having a user non-perceivable light source. Note that the bulb heater light is only on during warm-up, fusing, and time-out intervals of operation. Any time the printer is off, or not in use, a power save function in the printer turns everything possible off to save energy, including display LEDs. When a print job is sent, the printer is turned on, and the fusing unit starts warm-up, so the bulb heater comes on when data begins to be received by the printer. The bulb heater remains on for actual use of printer, and then for some time afterwards, in anticipation of another print job. This is the time-out timer aspect of laser printer operation. Either another print job is received, which keeps the fuser bulb heater on, or the time out timer expires. Time-out time in modern laser printers is about one minute. Thus, the illumination of the user perceivable components is consistent with the actual operational periods of the printer.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A printing device, comprising:

a fusing unit having a bulb heater that emits user non-perceivable light;

a means for conveying light from the bulb heater to a location within the printing device, and a component positioned at said location to receive the light conveyed by said means conveying light, said component operable to utilize the light for illumination thereof in a user perceivable manner.

2. A method of utilizing light emitted from a user non-perceivable light source in a machine having a user perceivable component positioned at a first location, comprising the steps of:

directing energy from the user non-perceivable light source to a second location;

conveying light from the user non-perceivable light source to the first location; and illuminating the user perceivable component with said conveyed light, wherein said component is a logo.

3. The method of claim 2 wherein said conveying step is accomplished through an unobstructed pathway from the user non-perceivable light source to said location.

4. The method of claim 2 wherein said conveying step includes the step of reflecting the light from a reflective surface toward the location.

5. The method of claim 2 wherein said convey step is accomplished by using a light pipe.

6. The method of claim 2 wherein said conveying step is accomplished by using a fiber optic.

7. The method of claim 2 wherein the component is translucent.

8. A method of utilizing light emitted from a user non-perceivable light source in a machine having a user perceivable component positioned at a location, comprising the steps of:

intermittently conveying light from the user non-perceivable light source to the location; and illuminating the user perceivable component with said conveyed light.

9. A method of utilizing light emitted from a user non-perceivable light source in a machine having a user perceivable component positioned at a location, comprising the steps of:

intermittently conveying light from the user non-perceivable light source to the location; and illuminating the user perceivable component with said conveyed light;

wherein the machine includes a device characterized by periodic motion, and wherein said conveying step is accomplished periodically according to the periodic movement of the device characterized by periodic motion.

10. A media processing device, comprising:

a fusing unit;

a bulb heater disposed within said fusing unit; and an arrangement for utilizing light from the bulb heater for illumination.

11. A system for utilizing light emitted from a user non-perceivable light source in a machine having a user perceivable component positioned at a location, comprising:

means for conveying light from the user non-perceivable light source to the location; and means for intermittently illuminating the user perceivable component with said conveyed light.

12. A system for utilizing light emitted from a user non-perceivable light source in a machine having a user perceivable component positioned at a location, comprising:

means for conveying light from the user non-perceivable light source to the location; and means for illuminating the user perceivable component with said conveyed fight;

wherein the machine includes a device characterized by periodic motion and wherein said means for conveying includes means for periodically conveying light from the user non-perceivable light source to the location according to the periodic movement of the device characterized by periodic motion.

13. A system for utilizing light emitted from a user non-perceivable light source in a machine having a user perceivable component positioned at a location, comprising:

means for convoying light from the user non-perceivable light source to the location; and means for illuminating the user perceivable component with said conveyed light;

wherein the component is a logo.

14. The system of claim 13 including an unobstructed pathway from the user non-perceivable light source to said location.

15. The system of claim 13 including means for reflecting the light from a reflective surface toward the location.

16. The system of claim 13 wherein said means for conveying includes a light pipe.

17. The system of claim 13 wherein said means for conveying includes an optic fiber.

18. The system of claim 13 wherein the component is translucent.

* * * * *

UNITED STATES PATENT AND TRADEMARK OFFICE

CERTIFICATE OF CORRECTION

PATENT NO. : 6,940,044 B2
APPLICATION NO. : 10/620139
DATED : September 6, 2005
INVENTOR(S) : Eric Unger Eskey It is certified that error appears in the above-identified patent and that said Letters Patent is hereby corrected as shown below:

IN THE SPECIFICATION

Column 3, line 12, after "machines," insert --including laser printers, facsimile machines, laser photocopying machines,--

IN THE CLAIMS

Claim 12, Column 14, line 8, delete "fight" and insert therefor --light--

Signed and Sealed this

Third Day of July, 2007

JON W. DUDAS
*Director of the United States Patent and Trademark Office*